US005373952A

United States Patent [19]

Sugiura

[11] Patent Number: 5,373,952

[45] Date of Patent: Dec. 20, 1994

[54] PNEUMATIC SHOCK ABSORBER IN COMPOUND TROLLEY CONVEYOR

[75] Inventor: Tetsuya Sugiura, Hanno, Japan

[73] Assignee: Tsubakimoto Chain Co., Osaka, Japan

[21] Appl. No.: 218,151

[22] Filed: Mar. 25, 1994

Related U.S. Application Data

[63] Continuation of Ser. No. 979,592, Nov. 20, 1992, abandoned.

[30] Foreign Application Priority Data

Nov. 22, 1991 [JP] Japan ..... 3-103803[U]

[51] Int. Cl.[5] ..... B61G 9/16

[52] U.S. Cl. ..... 213/43; 104/172.3

[58] Field of Search ..... 213/7, 40 R, 40 S, 43; 104/172.3; 267/120, 64.25; 188/301, 312

[56] References Cited

U.S. PATENT DOCUMENTS

| | | | |
|---|---|---|---|
| 541,351 | 6/1895 | Gordon | 188/301 |
| 2,590,406 | 3/1952 | Haas | 213/43 X |
| 2,915,198 | 12/1959 | Spencer | 213/43 |
| 3,009,584 | 11/1961 | Gibson | 213/43 |
| 3,170,575 | 2/1965 | Gibson | 213/43 |
| 3,193,112 | 7/1965 | Karakashjan et al. | 213/43 |
| 5,027,715 | 7/1991 | Moore et al. | 104/172.3 |

FOREIGN PATENT DOCUMENTS 64-30773 2/1989 Japan .

*Primary Examiner*—Robert J. Oberleitner
*Assistant Examiner*—S. Joseph Morano
*Attorney, Agent, or Firm*—Flynn, Thiel, Boutell & Tanis

[57] ABSTRACT

A shock absorber in a compound trolley conveyor, including two cylinders disposed between a foremost trolley and a front trolley of the compound trolley conveyor and connected together face to face with each other, and two pistons inserted into the cylinders respectively and interconnected. When an impact force is applied to a carrier member at the time of connection or disconnection between the trolley connected to the carrier member and a drive chain, one piston moves in a direction to compress the air in the associated cylinder, while the other piston moves in a direction to withdraw or exhaust air from the associated cylinder. By such air compressing and withdrawing actions, the impact energy is absorbed to buffer the impact force. The compressed air in one cylinder slowly flows out to the exterior from a piston-cylinder gap, while the outside air slowly flows into the other cylinder through a piston-cylinder gap.

2 Claims, 4 Drawing Sheets

PNEUMATIC SHOCK ABSORBER IN COMPOUND TROLLEY CONVEYOR

This application is a continuation of U.S. Ser. No. 07/979,592, filed Nov. 20, 1992 now abandoned.

FIELD OF THE INVENTION

The present invention relates to a shock absorber for buffering, by preventing the occurrence of a repulsive force, an impact force developed at the time of connection or disconnection between a chain and a carrier member in a compound trolley conveyor which is used, for example, in an automobile body coating and drying line.

BACKGROUND OF THE INVENTION

According to the prior art, a carrier member (e.g. a flatcar) of a compound trolley conveyor (not shown) is adapted to travel by being pulled with a drive chain through a trolley. The trolley and the drive chain are connected together by a connection means (not shown) which is capable of making engagement and disengagement.

To start the movement of the carrier member when it is at rest, it is necessary that the carrier member be connected to the drive chain which is traveling, using the connection means. Conversely, for stopping the movement of the carrier member when it is traveling, it is necessary to disconnect the carrier member from the drive chain, using the connection means. In the first case, however, since the drive chain which is traveling is suddenly connected to the carrier member which is at rest, the tractive force is sometimes exerted as an excessive impact force on the carrier member.

Therefore, with a view to buffering such impact force, for example the shock absorber (not shown) disclosed in Japanese Utility Model Laid Open No. 30773/1989 (Application No. 125635/1987) is disposed between a foremost trolley and a front trolley in a compound trolley conveyor. The shock absorber is composed of two piston-cylinder mechanisms disposed concentrically face to face with each other and springs which are compressed by the pistons, whereby an impact force is absorbed by compression of the air in each cylinder and compression of the springs.

In such conventional shock absorber, however, since the buffered energy is accumulated in the compressed air and springs and acts as a repulsive force on the pistons, the pistons repeat pulsations reciprocating in the traveling direction and thereafter stop. Consequently, the carrier member vibrates repeatedly in the traveling direction and this repeated vibration may cause damage to the article on the carrier member.

According to the present invention, in order to solve the above-mentioned problem, there is provided a shock absorber in a compound trolley conveyor, including two cylinders disposed between a foremost trolley and a front trolley of the compound trolley conveyor and connected together face to face with each other and two pistons inserted into the cylinders respectively and interconnected, wherein with movement of the pistons, the air in one of the cylinders is compressed and the air in the other cylinder is exhausted.

According to the shock absorber of the present invention, when an impact force is applied to the carrier member at the time of connection or disconnection between the trolley connected to the carrier member and a drive chain, one piston moves in a direction to compress the air in the associated cylinder, while the other piston moves in a direction to withdraw or exhaust air from the associated cylinder. By such air compressing and withdrawing actions, the impact energy is absorbed to buffer the impact force.

The compressed air in one cylinder slowly flows out to the exterior from the piston-cylinder gap, while the outside air slowly flows into the other cylinder through the piston-cylinder gap. Therefore, there is no fear of the impact energy acting as a repulsive force on the piston and hence the impact force is buffered without pulsation of the carrier member.

An embodiment of the present invention will be described below with reference to the drawings.

DETAILED DESCRIPTION

Figure 1:
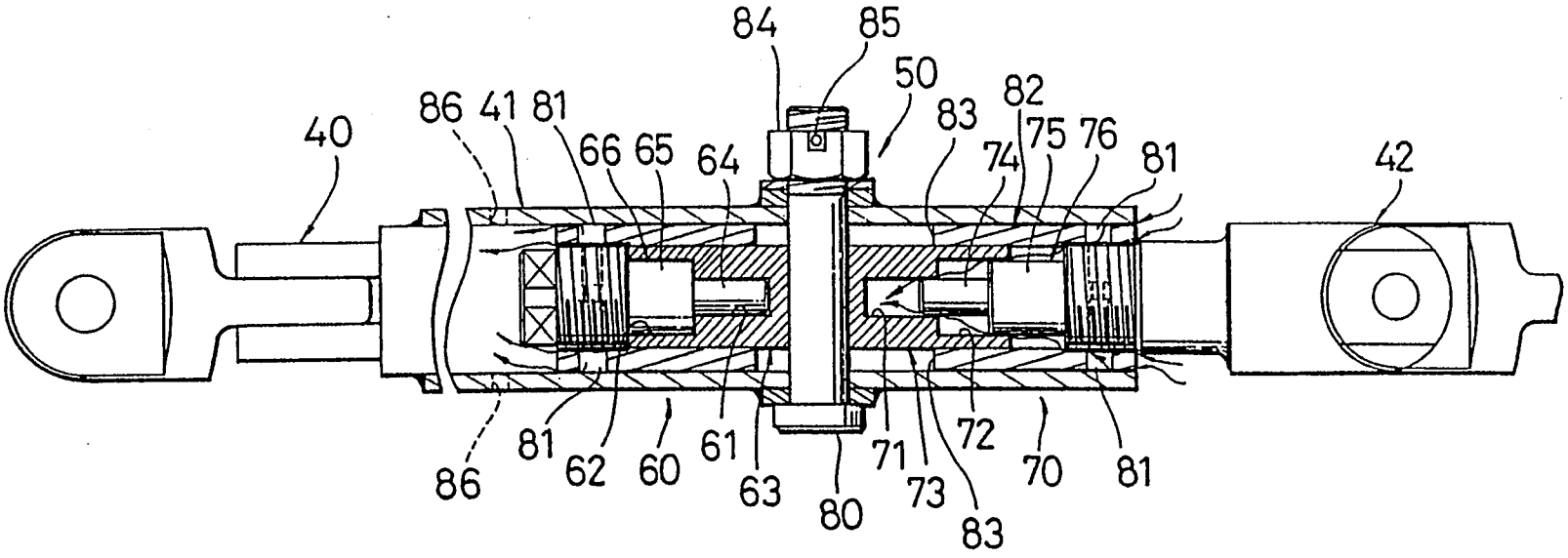
FIG. 1 is a sectional view, broken away in the longitudinal direction, of a shock absorber embodying the present invention and shown in the state when a carrier member starts traveling.

First, a compound trolley conveyor (see FIG. 3) in which a shock absorber embodying the invention is provided, will be described.

A carrier member formed as a flatcar 10 of the compound trolley conveyor C comprises a lower frame 12 framed in a square form and having swivel wheels (i.e. casters) 11 mounted to the underside at the four corners; an upper frame 14 also framed in a square shape and provided on the upper surface thereof with support means 13 which support an article carried on the flatcar 10, for example, an automobile body M to be coated; and connecting means 15, 15 for connection of the upper and lower frames 12, 14.

The swivel wheels 11 are required for the flatcar 10 to travel on guide rails (not shown) when moving within a line, e.g. a coating booth B, which requires a stable travel of the flatcar 10.

A chain rail 20 and a carrier rail 30 are laid with difference in height on the floor or the bottom G of a pit formed by cutting out the floor in a channel-like shape.

The chain rail 20 is for movably guiding a drive trolley 22 which moves integrally with a drive chain 21.

The carrier rail 30 is for guiding a foremost trolley 32 which is connected to the drive trolley 22 by a releasable connecting means 31, a front trolley 34 and a rear trolley 35 at the respective front and rear portions of the flatcar 10, and a rearmost trolley 37 which is connected to the rear trolley 35 by a connecting bar 36.

The foremost trolley 32 is connected through a first joint 40 to a connecting bar 41 which in turn is connected through a shock absorber 50 and a second joint 42, to the front trolley 34.

The front and rear trolleys 34, 35 are for the support and conveyance of the flatcar 10. On the rearmost trolley 37 there is provided a disengaging piece or cam 38 which, upon collision with the flatcar 10 by a following or succeeding flatcar (not shown), causes the connection means 31 of the succeeding flatcar to operate and release, thereby disengaging the foremost trolley of the succeeding flatcar from the drive chain 21.

The shock absorber 50 will now be described.

The shock absorber 50 (see FIG. 1) is mounted within the connecting bar 41 which is pipe-like. The connecting bar 41 at its front end is connected to the first joint 40.

The shock absorber 50 is composed of a first cylinder mechanism 60 and a second cylinder mechanism 70 which are formed concentrically and aligned so as to be face to face with each other. That is, the cylinder mechanisms 60 and 70 act in opposite directions.

The first and second cylinder mechanisms 60, 70 are respectively provided with two-stepped cylinders 63 and 73 having small inside diameter bore portions 61, 71 and large inside diameter bore portions 62, 72 and also provided with two-stepped pistons 66 and 76 having small outside diameter portions 64, 74 and large outside diameter portions 65, 75. The piston 76 of the second cylinder mechanism 70 is provided as part of the second joint 42. Between the cylinders 63, 73 and the pistons 66, 76 there are formed gaps (not shown) respectively to permit a limited air flow. These gaps, for example, are typically formed as small annular clearances as defined between the exterior piston wall and the surrounding interior cylinder wall.

The cylinders 63 and 73 are made of brass or bronze, for example.

Although the bores in the first and second cylinder mechanism 60, 70 are of two steps comprising the small diameter portions 64, 74 and the larger diameter portions 65, 75, they may be of only one step, either the small or the large diameter portions.

The two cylinders 63 and 73 are integrally formed concentrically face to face with each other and are connected to the connecting bar 41 and fixed so as not to move in the longitudinal direction of the bar 41 by means of a pin 80 extending through the bar 41.

The two pistons 66 and 76 are connected to a surrounding connecting pipe 82 by engagement of external threads and internal threads. This threaded engagement is prevented from becoming loose by means of four set-screws 81. Between the external and internal threads there usually is formed a gap which permits a limited air flow.

In the connecting pipe 82 there are formed elongated holes 83, 83 in the longitudinal direction of the connecting pipe 82 through which holes the pin 80 extends. The connecting pipe 82, which is formed of carbon steel for example, is interposed between the pistons 66, 76 and the connecting bar 41. The pin 80 is prevented from dislodgement by means of both a nut 84 and a locking pin 85 extending through the pin 80.

The following description is now provided about the operation.

Figure 3:
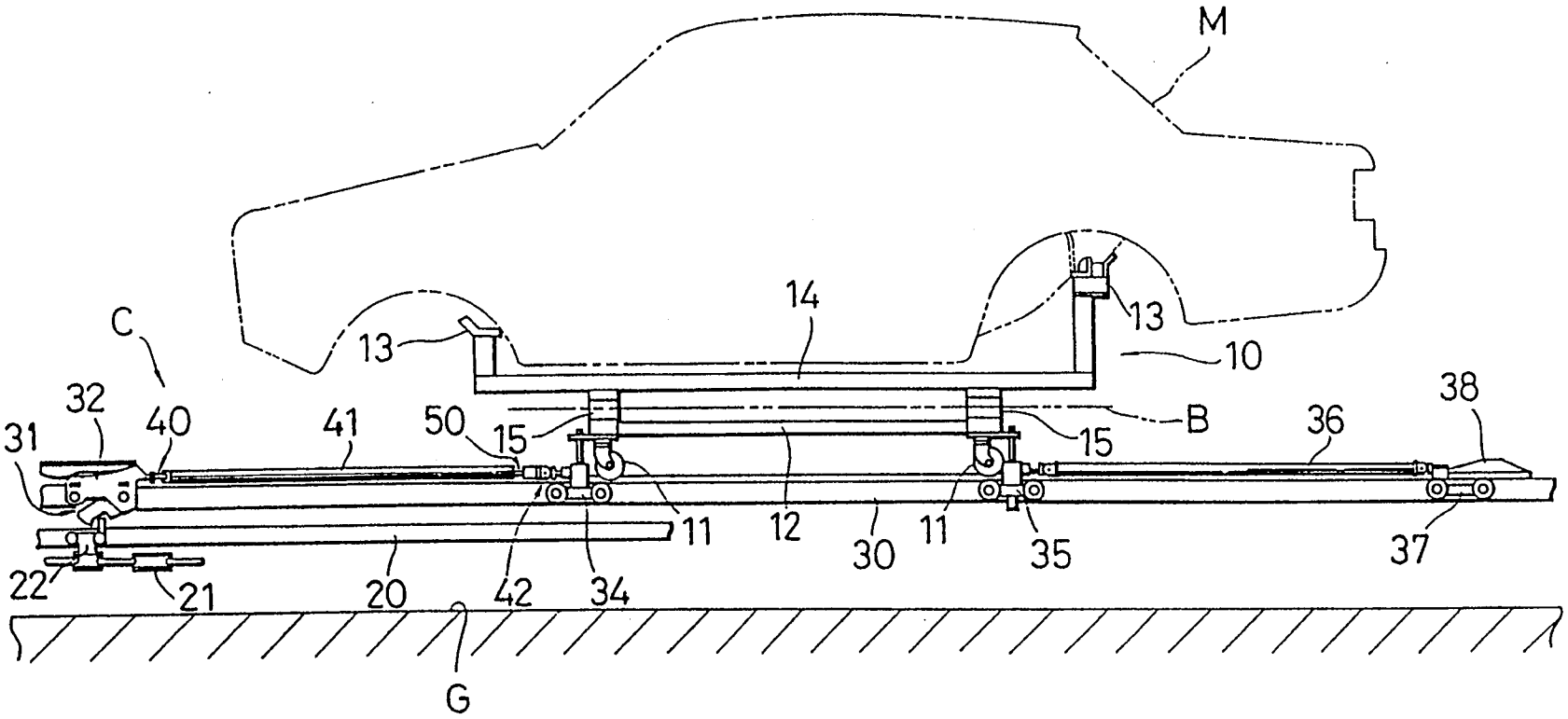
FIG. 3 is a schematic front view of a compound trolley conveyor.
Figure 4:
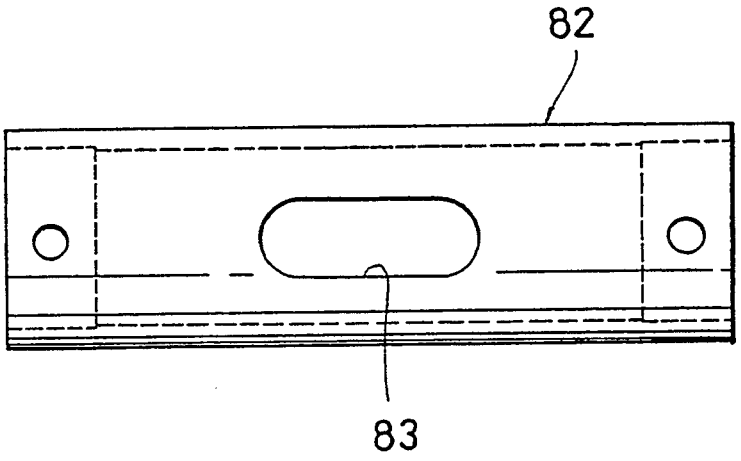
FIG. 4 is a plan view of a connecting pipe.

The drive chain 21 moves leftward in FIG. 3 integrally with the drive trolley 22 and is connected through the connecting means 31 with the foremost trolley 32 which is at rest. The foremost trolley 32 then tows the flatcar 10 through the connecting bar 41 and the shock absorber 50, but the flatcar 10 cannot start movement immediately due to its own weight and the weight of the automobile body M.

Therefore, a large tractive force is required, and the cylinders 63, 73 move leftward in FIG. 1 with respect to the pistons 66 and 76 which are at rest, while being pulled by the connecting bar 41. With this movement of the cylinders 63 and 73, the spacing between the foremost trolley 32 and the front trolley 34 expands.

With the aforesaid movement of the cylinders 63 and 73, the internal volume of one cylinder 63 decreases, while that of the other cylinder 73 increases. When the air compression resistance based on such reduction in volume, the air withdrawing resistance based on such increase in volume, and the weight of the flatcar 10 and that of the automobile body M are balanced, the tractive force of the foremost trolley 32 is transmitted to the flatcar 10, so that the flatcar 10 starts moving.

At this time, in the shock absorber 50, the impact energy is absorbed by the air compression resistance and withdrawing resistance in the cylinders 63 and 73 to buffer the impact force exerted on the flatcar 10.

More specifically, the air in cylinder 63, as it is compressed, slowly flows into the connecting bar 41 through the gap between the cylinder 63 and the piston 66 and further through the gap in the threadedly engaged portion between the piston 66 and the connecting pipe 82, as indicated by arrows in FIG. 1. Since the internal volume of the connecting bar 41 is larger than that of the cylinder 63, the internal pressure of the connecting bar 41 will not rise even when the air in the cylinder 63 flows into the connecting bar 41, and so it will not become difficult for the air to flow into the bar 41.

With increase in volume of the other cylinder 73, the outside air slowly flows into the cylinder 73 through the gap in the threadedly engaged portion between the piston 76 and the connecting pipe 82 and the gap between the cylinder 73 and the piston 76, as also indicated by arrows in FIG. 1.

Thus, the air in the cylinder 63 slowly flows out and hence the interior of the cylinder 63 is not held at an increased pressure, whereby the impact energy absorbed by the compressed air will not act as a repulsive force on the pistons 66 and 76.

Consequently, the flatcar 10 starts traveling smoothly without reciprocating motions (pulsation) in the traveling direction.

Lastly, the piston 66 comes into abutment with the cylinder 63, whereby the flatcar 10 is towed by the connecting bar 41 and travels leftward in FIG. 3.

Upon storage or stoppage of a preceding flatcar during travel thereof, the connecting means 31 of a succeeding flatcar abuts the disengaging piece 38 of the preceding car, so that the foremost trolley 32 of the succeeding flatcar is disconnected from the drive chain 21. Thereafter, the foremost trolley 32 of the succeeding flatcar comes into contact in the state of a rear-end collision with the rearmost trolley 37 of the preceding flatcar which is at rest, and the succeeding flatcar stops.

Figure 2:
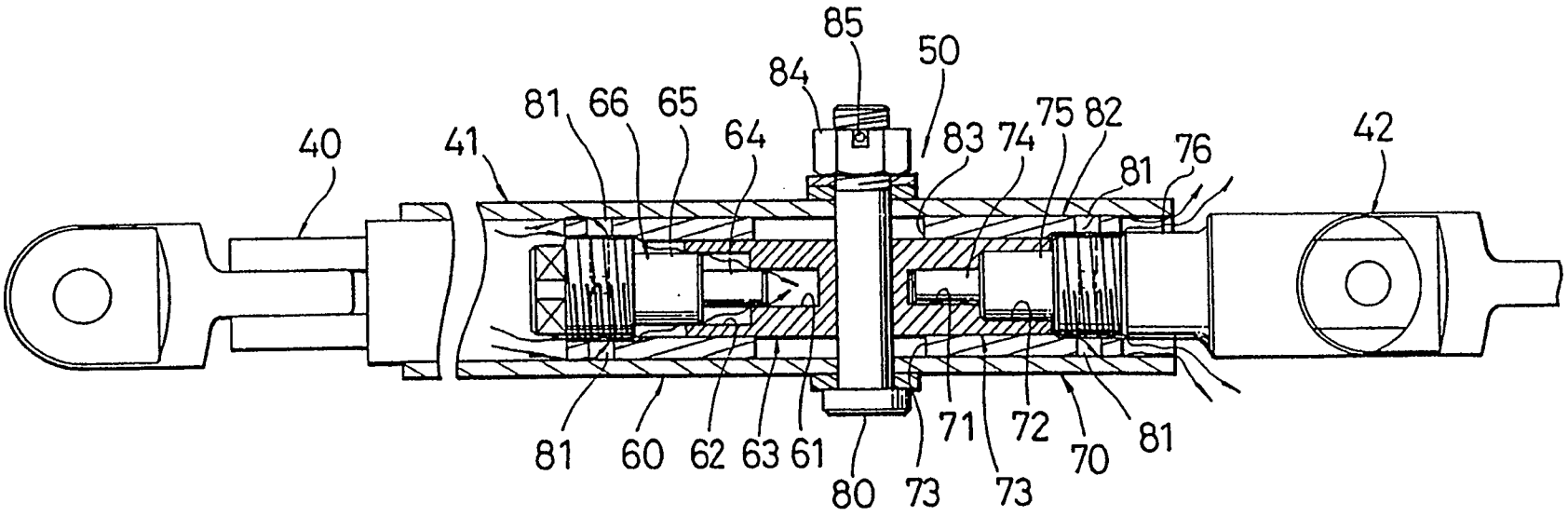
FIG. 2 is a view like FIG. 1 but showing the shock absorber in the state when the carrier member is at rest.

At this time, the succeeding flatcar 10 cannot stop immediately due to its own weight and the weight of the automobile body M, but travels inertially, causing the pistons 66 and 76 to move leftward in FIG. 2 with respect to the stopped cylinders 63 and 73, whereby the spacing between the foremost trolley 32 and the front trolley 34 is narrowed.

With the movement of the pistons 66 and 76, moreover, the internal volume of cylinder 73 decreases, while that of the other cylinder 63 increases.

Due to the compressive resistance and withdrawing resistance of the air in the cylinders 63 and 73 based on such change in volume, the shock absorber 50 causes the flatcar 10 to decelerate and stop without imposing an impact force on the flatcar 10.

During this period, as the compression proceeds, the air in cylinder 73 slowly flows out to the exterior through the gap between the cylinder 73 and the piston 76 and the gap in the threadedly engaged portion between the piston 76 and the connecting pipe 82, as shown by arrows in FIG. 2. Into the other cylinder 63, as its internal volume increases, the air in the connecting bar 41 enters slowly through the gap in the threadedly engaged portion between the piston 66 and the connecting pipe 82 and the gap between the cylinder 63 and the piston 66, as also shown by arrows in FIG. 2.

Since the internal volume of the connecting bar 41 is larger than that of the cylinder 63, the internal pressure of the bar 41 will not significantly drop even when the air in the bar 41 flows into the cylinder 63, so that it will not become difficult for the air in the bar 41 to flow into the cylinder 63.

Thus, the air in the cylinder 73 flows out and therefore the interior of the cylinder 73 is not held in a state of increased pressure, so it is impossible that the impact energy which has been absorbed by the compressed air will act as a repulsive force on the pistons 66 and 76.

Consequently, the flatcar 10 begins to stop slowly without pulsation and stops completely upon abutment of the piston 76 with the cylinder 73 which is at rest.

Although in the above embodiment the two pistons 66 and 76 are connected by threaded engagement to the connecting pipe 82 and are prevented form becoming loose by the four set-screws 81, the threaded portions may be omitted and the two pistons may be merely inserted (not shown) into the two cylinders and connected to the connecting pipe 82 using set-screws. In this case, a gap which permits a limited air flow is formed between the pistons and the connecting pipe.

Further, in the case where the internal volume of the connecting bar 41 is small, small holes 86, 86 may be formed in the connecting bar 41, as indicated by broken lines in FIG. 1, to provide communication between the interior of the bar 41 and the exterior so as not to obstruct the flow of air to or from the cylinder 63.

Since the shock absorber of the present invention has two cylinders in a face-to-face relation (i.e., acting in opposite directions) with each other, the impact force can be buffered under substantially the same conditions in both the case where the carrier member is to be moved and the case where it is to be stopped.

Further, since the air in one cylinder which has been compressed slowly flows out to the exterior through the piston-cylinder gap, the impact energy absorbed by the compressed air will not act as a repulsive force on the piston and therefore it is possible to buffer the impact force without pulsating the carrier member.

In the shock absorber according to this invention, the piston-cylinder arrangements allow rapid pressure build up therein so as to absorb the energy caused by impact of starting or stopping traveling, and the gaps act as flow restrictions so as to allow for controlled flow of air to or from the cylinders so as to reduce the pressure in the cylinder and prevent pressure-induced pulsations in the system.

Additionally, since the oil which is usually employed in this type of shock absorbers is not used in the shock absorber of the present invention, the maintenance is easy and there is no fear of stain; it becomes possible to use the shock absorber even for the oven in the coating/drying line.

The embodiments of the invention in which an exclusive property or privilege is claimed are defined as follows:

1. A pneumatic shock absorber in a compound trolley conveyor, comprising:

first and second cylinders disposed between a foremost trolley and a front trolley of the compound trolley conveyor and connected together in face to face relation;

first and second pistons disposed in said first and second cylinders, respectively, with an annular gap between each cylinder and respective piston and means for mechanically interconnecting said first and second pistons for joint movement relative to the first and second cylinders, wherein with said joint movement of said first and second pistons, internal volume of one of said cylinders is decreased so that air therein is compressed and caused to exit through the annular gap between said one of said cylinders and said respective piston therein so as to avoid pressure-induced pulsations of said pistons and internal volume of the other of said cylinders is increased so that air is drawn therein through the annular gap between said other of said cylinders and the respective piston.

2. A pneumatic shock absorber in a compound trolley conveyor, comprising:

first and second cylinders disposed between a foremost trolley and a front trolley of the compound trolley conveyor and connected to each other in face-to-face relation;

first and second pistons disposed in said first and second cylinders, respectively, with an annular gap between each cylinder and respective piston and a tubular member disposed about the first and second cylinders and connected to the first and second pistons so as to interconnect them for joint movement relative to the first and second cylinders, wherein with said joint movement of said first and second pistons, internal volume of one of said cylinders is decreased so that air therein is compressed and caused to exit therefrom through the annular gap between said one of said cylinders and said respective piston therein so as to avoid pressure-induced pulsations of said pistons and internal volume of the other of said cylinders is increased so that air is drawn therein through the annular gap between said other of said cylinders and the respective piston.

* * * * *